United States Patent [19]

Higuchi

[11] 3,988,937

[45] Nov. 2, 1976

[54] DEVICE FOR PRODUCING FEEDING STROKE OF TRANSFER FEEDER FOR USE IN TRANSFER PRESS

[75] Inventor: Makoto Higuchi, Komatsu, Japan

[73] Assignee: Kabushiki Kaisha Komatsu Seisakusho, Tokyo, Japan

[22] Filed: Dec. 10, 1975

[21] Appl. No.: 639,589

[30] Foreign Application Priority Data

Dec. 10, 1974 Japan ..... 49-148876[U]

[52] U.S. Cl. ..... 74/45; 74/600; 198/621; 214/1 BB

[51] Int. Cl.[2] ..... F16H 21/32

[58] Field of Search ..... 214/1 BB; 74/27, 600, 74/45; 198/218

[56] References Cited

UNITED STATES PATENTS

| | | | |
|---|---|---|---|
| 2,997,888 | 8/1961 | Rust | 74/600 X |
| 3,910,127 | 10/1975 | Tanaka | 74/40 |

*Primary Examiner*—Frank E. Werner
*Assistant Examiner*—George F. Abraham
*Attorney, Agent, or Firm*—Armstrong, Nikaido & Wegner

[57] ABSTRACT

Device for producing and adjusting the feeding stroke of a transfer feeder for use in a transfer press which has a carrier for mounting thereon a pair of parallelly spaced transfer bars extending in the longitudinal direction of a working table of the press. The carrier is reciprocally moved along a pair of guide rods extending parallel to the transfer bars by the action of a transmitting mechanism connected to a drive source of the press. The transmitting mechanism comprises a pair of gears engaged with each other and one of which is connected to the drive source; a pair of levers, each fixedly secured at its proximal end to respective shaft of the gears; a link pivotally connected at its proximal end to the free end of one of said levers and having a longitudinally extending recess at a laterally intermediate portion of the back thereof; a first roller rotatably mounted on the free end of the other lever and slidably engaged with the recess of the link; a groove formed in a longitudinally intermediate portion of the back of the carrier and extending perpendicular to said transfer bars; and a second roller rotatably mounted through an adjusting mechanism on the link and slidably engaged with the groove of the carrier.

4 Claims, 5 Drawing Figures

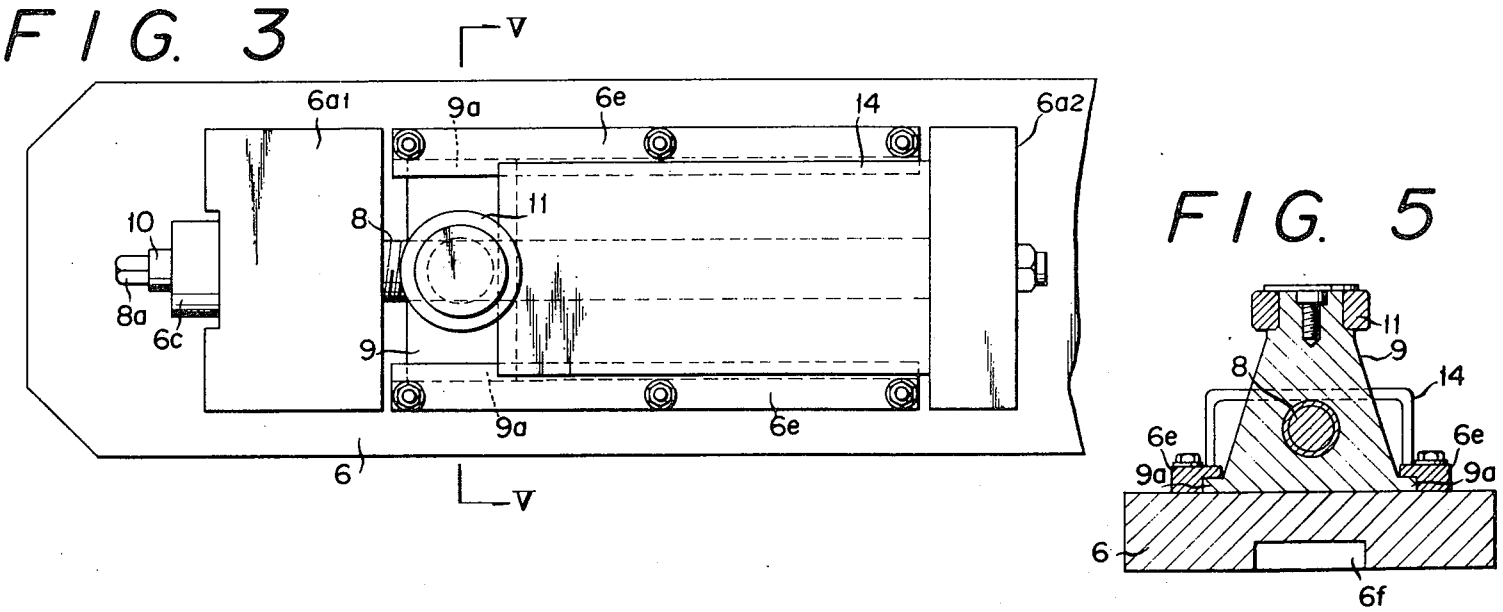
FIG. 3
FIG. 5
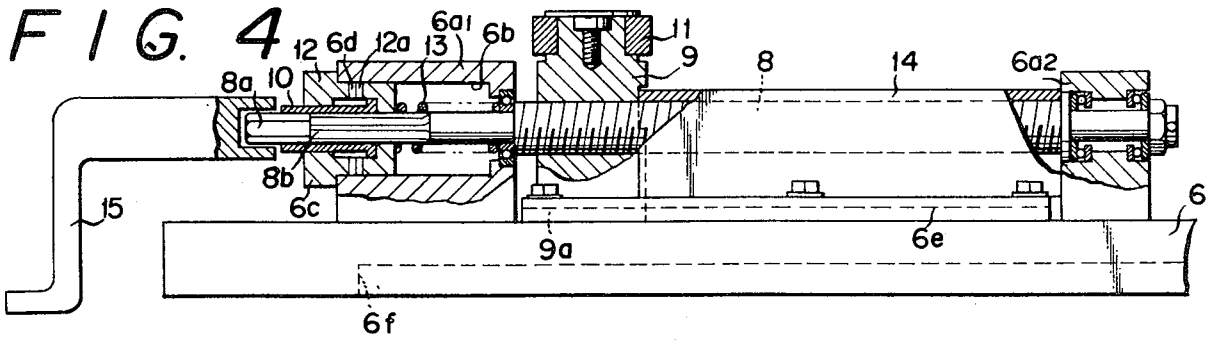
FIG. 4

DEVICE FOR PRODUCING FEEDING STROKE OF TRANSFER FEEDER FOR USE IN TRANSFER PRESS

BACKGROUND OF THE INVENTION

1. Field of the Invention

This invention relates to a device for producing and adjusting the feeding stroke of a transfer feeder for use in a transfer press or the like in which multi-step press workings are successively performed on the working table thereof.

2. Description of the Prior Art

Heretofore, the device of this type is so called as a gripper transfer device by which, after respective preceding press working steps, work pieces disposed on a working table of a transfer press or the like at their respective working stations in which said respective preceding press working steps are carried out are respectively gripped and then successively transmitted to their respective succeeding working stations so as to be sujected to their respective succeeding press working steps during the interval from the ascent of a slide of the press to the descent thereof. In order to achieve such an operation as mentioned above, such a high price and complex structured device as a Geneva cam mechanism or a planetary gear mechanism has been utilized in a previously provided device. Furthermore, the feeding stroke of the tranfer feeder which is obtained by the previously provided device has been a fixed feeding stroke, and yet not variable. Therefore, the transfer feeder has had to be interchanged to another one having a different feeding stroke at each time when it has been required to vary the feeding stroke depending upon the work pieces to be worked and the arrangement of the working stations therefor.

This invention aims at avoiding the above described disadvantages and inconveniences.

SUMMARY OF THE INVENTION

A primary aspect of the present invention is to provide a novel and useful device for producing the feeding stroke of a transfer feeder for use in a transfer press or the like which is in a simple construction and can easily adjust the feeding stroke.

In accordance with the aspect of the present invention, there is provided one preferred embodiment of a device for producing the feeding stroke of a transfer feeder for use in a transfer press or the like, said device having a carrier for mounting thereon a pair of parallelly spaced transfer bars extending in the longitudinal direction of a working table of said press, said carrier being slidingly supported by a pair of guide rods extending parallel to said transfer bars and being connected through a transmitting mechanism to a driving source of said press, wherein said transmitting mechanism comprises a pair of gears engaged with each other, one of which is a drive gear rotated by said driving source; a pair of levers, each fixedly secured at its proximal end to respective rotatable shaft of said gears; a link pivotally connected at its proximal end to the distal end of one of said levers and said link having a straight elongated recess formed in the back thereof and extending in the longitudinal direction thereof; a first engaging member pivotally mounted on the distal end of the other lever and slidingly engaged with the recess of said link; a straight elongated groove formed in the back of said carrier and extending in the direction perpendicular to said transfer bars; and a second engaging member pivotally mounted on said link and slidingly engaged with the groove of said carrier, whereby said carrier is reciprocally moved together with said transfer bars along said guide rods following to a cyclical movement of said first engaging member traced on a determined locus thereof when said pair of gears is rotated, thereby causing the transfer bars to produce the feeding stroke.

In the embodiment, the second engaging member is mounted on an adjusting member threadingly engaged with an adjusting screw longitudinally mounted on the link so that the position of the second engaging member where difines a substantial length of the link is shifted when the adjusting screw is rotated.

With the above arrangement, the adjustment of the feeding stroke is very easily carried out, and yet the construction is made remarkably simple.

BRIEF DESCRIPTION OF THE DRAWINGS

The above and other features and advantages of the present invention will be apparent from the following description taken in conjunction with the accompanying drawings in which:

FIG. 3 is a fragmentary enlarged plan view showing an arrangement of a feeding stroke adjusting mechanism of the device of the present invention;

FIG. 4 is a partly cross-sectional side view of the arrangement shown in FIG. 3; and FIG. 5 is a cross-sectional view taken in line V—V in FIG. 4.

DETAILED DESCRIPTION OF THE PREFERRED EMBODIMENTS

Figure 1:
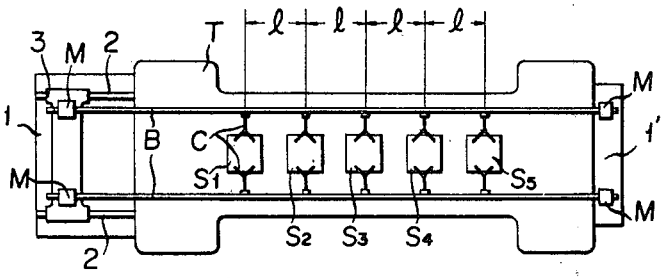
FIG. 1 is a schematic plan view showing a working table of a transfer press and a general arrangement of a transfer feeder incorporating therein a device for producing the feeding stroke of the transfer feeder constructed in accordance with the aspect of the present invention.

Referring to FIG. 1 which shows a general arrangement of a transfer feeder incorporating therein a device for producing the feeding stroke of the transfer feeder of the present invention, the main body 1 of the transfer feeder is disposed at one side of the working table T of a machine tool such as a transfer press, while the auxiliary body 1' is provided at the other side of the table T.

The body 1 securely mounts thereon a pair of parallelly spaced guide rods 2, as shown, on which a carrier 3 is slidably mounted so as to be reciprocally moved in such a manner of producing the feeding stroke of the transfer feeder. Each of the carrier 3 and the auxiliary body 1' respectively mounts thereon a pair of actuating mechanisms M on which a pair of parallelly spaced transfer bars B extending in the longitudinal direction of the working table T are supported at their respective ends.

The actuating mechanisms M respectively mounted on each of the carrier 3 and the auxiliary body 1' are moved toward and away from each other in timed relation to the reciprocal movement of the carrier 3 when the carrier 3 is temporarily held stationarily during the reciprocal movement thereof so that, when the transfer bars B are moved toward each other and held at their respective approaching positions so as to clamp work pieces (not shown) disposed at their respective working stations $S_1$, $S_2$, $S_3$, $S_4$ and $S_5$ spaced apart at a distance *l* from each other by their respective opposing clamping arms C, C and then the carrier 3 is moved by the distance *l* in the direction toward the auxiliary body 1', the work pieces are transferred to their respective succeeding working stations. After the work pieces are transferred, the transfer bars B are moved apart from each other so that the work pieces are left at their respective succeeding working stations to which they have just transferred and the transfer bars B are moved back as the carrier 3 is moved in its return stroke, and these procedures are repeated so as to continuously and successively feed the work pieces to their respective succeeding working stations.

Since the operation of the transfer bars B per se is not the subject matter of the present invention, it is not described in detail here.

Figure 2:
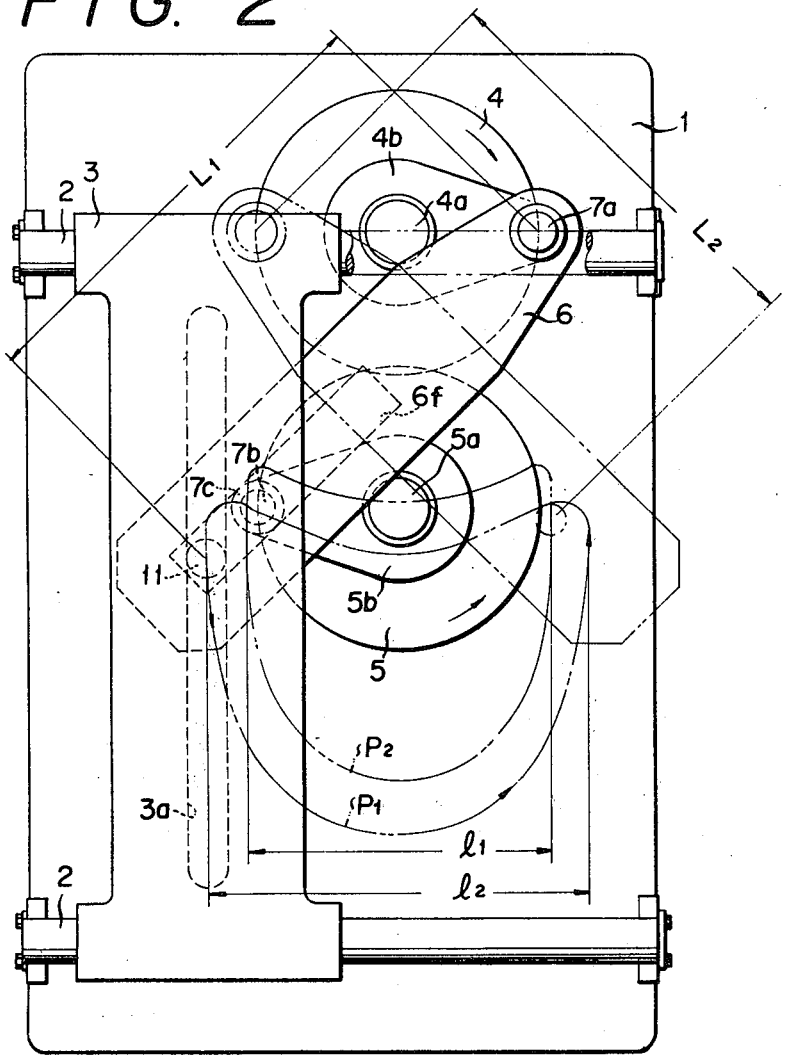
FIG. 2 is a plan view showing the construction of the device shown in FIG. 1 from which transfer bars and a operating mechanism therefor are omitted so as to illustrate the internal construction of the device.

Referring now to FIG. 2, showing the device for producing the feeding stroke of the transfer feeder of the present invention, a pair of gears 4, 5 are fixedly supported by shafts 4*a*, 5*a* on the main body 1 beneath the carrier 3, which gears are meshed with each other and driven by a driving source (not shown) in the opposite directions to each other, the rotational speed being related to the operation of the press (not shown) to which the transfer feeder is attached.

The gears 4 and 5 fixedly mount thereon levers 4*b* and 5*b*, respectively. Besides, the gears 4 and 5 are arranged in such a correlation that the phases of both gears with respect to angle of revolution are shifted to each other at 180 degrees.

The proximal end of a link 6 is pivotally connected to the distal end of the lever 4*b* by a shaft 7*a*, while a lateral intermediate portion of the back of the link 6 is formed with a straight elongated recess within which a first engaging member 7*c*, such as, for example, a roller, rotatably mounted on a shaft 7*b* secured to the distal end of the lever 5*b* is slidingly engaged. Thus, when the gears 4 and 5 are rotated, the link 6 is cyclically moved in a determined locus. The cyclical movement of the link 6 is utilized is giving the reciprocal movement of the carrier 3 and hence the feeding stroke of the transfer feeder as described later.

Reference is made to FIGS. 3 to 5, a bearing box $6a_1$ is mounted on the distal end of the link 6 while a bearing box $6a_2$ is mounted on a longitudinal intermediate portion of the link 6.

An adjusting screw rod 8 is rotatably supported at the portions thereof adjacent to its respective ends by the bearings $6a_1$ and $6a_2$, respectively, as shown in FIG. 4. The movement of the screw rod 8 in the axial direction thereof is prevented by the braring boxes $6a_1$ and $6a_2$.

An adjusting member 9 having a second engaging member 11, such as, for example, a roller, rotatably mounted at the upper end thereof is threadedly engaged with the adjusting screw rod 8. Shoulder portions 9*a* projecting outwardly from each lower end of the adjusting member 9 are slidably secured by hook-shaped members 6*e*, respectively, provided on the link 6 as shown in FIGS. 3 to 5 so that the adjusting member 9 is prevented from rotation thereof about the screw rod 8 when the screw rod 8 is rotated. Thus, when the adjusting screw rod 8 is rotated, the adjusting member 9 together with the roller 11 is shifted along the axis of the screw rod 8 with respect to their positions relative to the link 6 so that the distance $L_1$ between the axis of the roller 11 and the axis of the shaft 7*a* (FIG. 2) which corresponds to the substantial length of the link 6 is adjustably varied by the rotation of the adjusting screw rod 8. With this arrangement, the roller 11 cyclically moves while tracing a determined locus $P_1$ as shown in FIG. 2 in accordance with rotation of the gears 4 and 5. When the distance $L_1$ is varied to the distance $L_2$ by shifting the position of the roller 11 together with the adjusting member 9, the locus of the roller 11 becomes $P_2$ as shown in FIG. 2. This variation of the locus of the roller 11 is utilized for adjusting the feeding stroke as described later.

The bearing box $6a_1$ has a hollow space 6*b* in which an extending portion of the adjusting screw rod 8 is projected. An intermediate part of the extending portion is formed with a spline portion 8*b*. Within the hollow space 6*b*, further, a cylindrical sliding member mounted on and engaged with the spline portion 8*b* is slidingly inserted so that the sliding member 12 is rotated together with the screw rod 8 when the screw rod 8 is rotated. A compression spring 13 is provided around the extending portion of the screw rod 8 between the sliding member 12 and the inner end wall of the hollow space 6*b* so that the sliding member 12 is normally urged against an annular end wall member 6*c* fixedly secured to the distal end face of the bearing box $6a_1$. The outer end surface of the sliding member 12 facing the end wall member 6*c* is formed with a serration 12*a*, while the inner end surface of the end wall member 6*c* facing the sliding member 12 is also formed with a serration 6*d* engageable with the serration 12*a* of the sliding member 12 so that, when the serrations 6*d* and 12*a* are engaged with each other by the action of the spring 13, the sliding member 12 and hence the adjusting screw rod 8 are prevented from rotating. On the other hand, when the serration 12*a* is disengaged from the serration 6*d*, the sliding member 12 as well as the adjusting screw rod 8 is permitted to be rotated. A sleeve 10 is slidably inserted in an annular space defined between the extending portion of the screw rod 8 and the end wall member 6*c*, one end thereof beng abutted against the sliding member 12, while the other end is projected outwardly of the end wall member 6*c* so that, when the sleeve 10 is urged to the inward of the bearing box $6a_1$ by urging the outer end of the sleeve 10, the sliding member 12 is moved against the action of the spring 13 so as to separate the serration 12*a* from the serration 6*d*, thereby permitting the rotation of the screw rod 8.

The distal portion of the extending portion of the screw rod 8 is formed with a polygonal portion 8*a* with which a manually operable handle 15 can be releasably engaged so as to actuate the adjusting screw rod 8, as shown in FIG. 4.

Turning now to FIG. 2, the carrier 3 is formed at the back thereof with a straight elongated groove 3*a* extending in the direction perpendicular to the guide rods 2 for the carrier 3. The roller 11 of the adjusting member 9 is slidably engaged with the groove 3*a* so that the cyclical movement of the roller 11, for example, traced along the locus $P_1$ or $P_2$ does not operate to move the carrier 3 in the direction parallel to the groove 3, but operate only to move the carrier 3 in the direction perpendicular to the groove 3. Thus, the carrier 3 together with the transfer bars (not shown) mounted on the carrier 3 are reciprocally moved along the guide rods 2 by such a distance as indicated by $l_2$ or $l_1$ shown in FIG. 2 when the gears 4 and 5 are rotated. As is clear from the foregoing description, the reciprocal movement $l_2$ or $l_1$ corresponds to the feeding stroke of the transfer feeder which is variable.

In operation, when it is desired to vary the feeding stroke depending on work pieces to be worked, the handle 15 is fitted on the polygonal portion 8*a* of the screw rod 8 and abutted against the outer end face of the sleeve 10 so as to move the sleeve 10 and the sliding member 12 along the extending portion of the screw rod 8 against the action of the spring 13 so that the serrations 12*a* and 6*d* are disengaged from each other to allow the rotation of the screw rod 8. In this condition, the handle 15 is rotated to rotate the screw rod 8 thereby permitting the adjusting member 9 to be shifted along the screw rod 8. As a result, the distance defined between the axis of the roller 11 and the axis of the shaft 7*a* is adjusted. The adjustment of the distance permits the movement of the roller 11 traced on a dermined locus to be varied as shown by the locus $P_1$ and $P_2$ in FIG. 2. When the locus $P_1$ is selected, the feeding stroke $l_1$ is given, while the locus $P_2$ is selected, the feeding stroke $l_2$ is given. The distance of $l_1$ or $l_2$ may be varied to any values depending upon the adjustments of the adjusting member 9 along the screw rod 8.

In case of adjusting the position of the roller 11 relative to the link 6, a positioning piece 14 having such an appropriate length that a predetermined feeding stroke can easily settled thereby is utilized. The positioning piece 14 is placed between the adjusting member 9 and the bearing box $6a_2$.

Namely, the handle 15 is rotated until adjusting member 9 is stopped by abutting against one end of the distance piece 14, while the other end thereof is held in abutting against the bearing box $6a_2$. This makes the adjustment very easy and simple.

After the adjustment has been completed, the distance piece 14 is removed and the handle 15 is detached from the distal end of the screw rod 8. The detaching of the handle 15 automatically allows the sliding member 12 to be abutted against the end wall member 6*c* by the action of the spring 13 so that the serrations 6*d* and 12*a* are again engaged with each other to prevent the screw rod 8 from being rotated in order to fix the adjusting member 9 to the adjusted position.

As is shown by the locus $P_1$ or $P_2$ in FIG. 2, the cyclical movement of the roller 11 has substantially parallel portions perpendicular to the movement of the carrier 3 and spaced apart from each other by the distance $l_1$ and $l_2$ which corresponds to the feeding stroke of the transfer feeder. When the roller 11 being moved along the parallel portions, the carrier 3 is substantially held in a stational state while the pair of transfer bars B shown in FIG. 1 are moved toward or apart from each other by the operation of the actuating members M so that each work piece is clamped by or released from the respective pair of clamping arms C for achieving a proper transfer operation of the transfer feeder.

As described above, it is apparent that the present invention provides a very useful device for producing and adjusting the feeding stroke of a transfer feeder which is simple in construction and easy to operate without requiring the interchange of the transfer feeder rendering the device to be economical.

What is claimed is:

1. In a device for producing the feeding stroke of a transfer feeder for use in a transfer press, said device having a carrier for mounting thereon a pair of parallelly spaced transfer bars extending in the longitudinal direction of a working table of said press, said carrier being slidingly supported by a pair of guide rods extending parallel to said transfer bars and being connected through a transmitting mechanism to a driving source or said press, the improvement characterized in that said transmitting mechanism comprises:

a. a pair of gears engaged with each other, one of which is a drive gear rotated by said driving source;

b. a pair of levers, each fixedly secured at its proximal end to respective rotatable shaft of said gears;

c. a link pivotally connected at its proximal end to the distal end of one of said levers, said link having a straight elongated recess formed in the back thereof and extending in the longitudinal direction thereof;

d. a first engaging member pivotally mounted on the distal end of the other lever and slidingly engaged with the recess of said link;

e. a straight elongated groove formed in the back of said carrier and extending in the direction perpendicular to said transfer bars;

f. a second engaging member pivotally mounted on said link and slidingly engaged with the groove of said carrier, whereby said carrier is reciprocally moved together with said transfer bars along said guide rods following to a cyclically movement of said first engaging member traced at a determined locus thereof when said pair of gears rotated, thereby causing the transfer bars to produce the feeding stroke;

g. a pair of bearing boxes, one of them being fixedly secured to the distal end of the link and having thereinto a cylindrical hollow space, and the other bearing box being fixedly secured to a longitudinally intermediate portion of the link;

h. an adjusting screw rod, one end thereof being rotatably supported by said one of bearing boxes, and the other end being rotatably supported by said the other bearing box;

i. an extending portion of said adjusting screw rod inserted through and projected outwardly of said annular hollow space of said one of bearing boxes;

j. an adjusting member mounted on said link for rotatably mounting said second engaging member and threadingly engaged with said adjusting screw rod;

k. means for slidingly securing shoulder portions formed at each lateral bottom side of said adjusting member onto said link so as to prevent the adjusting member from rotation itself rotated about said adjusting screw rod when the screw rod is rotated;

l. a cylindrical sliding member inserted into said hollow space and mounted on and slidably engaged with the extending portion of said adjusting screw rod, said sliding member having a serration at the outer end surface thereof;

m. an annular end wall member fixedly secured to the distal end face of said one of bearing boxes and having a serration at the inner end surface thereof, said serration being engageable with that of said sliding member;

n. a compression spring provided around the extending portion of said adjusting screw rod and between said sliding member and the inner end wall of said hollow space so as to normally urge the sliding member toward said end wall member to engage the serration of said sliding member with that of said end wall member; and o. a sleeve slidably inserted in an annular space defined between the extending portion of said adjusting screw rod and said end wall member, one end thereof being abutted against the sliding member and the other end being projected outwardly of said end wall member, wherein the position of said adjusting member as well as said second engaging member on said link is adjusted when pushing said sleeve into the hollow space of said one of bearing boxes so as to disengage the serration of said sliding member from that of said end wall member and when rotating said adjusting screw rod, thereby adjusting the feeding stroke of the transfer feeder.

2. A device as set forth in claim 1, wherein said extending portion of the adjusting screw rod comprises a spline portion formed at its intermediate part and a polygnal portion formed at its distal end part.

3. A device as set forth in claim 1, wherein said securing means comprises a pair of hook-shaped members, each fixedly secured onto said link.

4. A device as set forth in claim 1, further comprising a positioning piece having such an appropriate length as depending on a predetermined feeding stroke and placed between said adjusting member and said the other bearing box, thereby easily and quickly settling the adjusting position of said adjusting member as well as said second engaging member.

* * * * *

UNITED STATES PATENT OFFICE

CERTIFICATE OF CORRECTION

Patent No. 3,988,937 Dated November 2, 1976

Inventor(s) MAKOTO HIGUCHI

It is certified that error appears in the above-identified patent and that said Letters Patent are hereby corrected as shown below:

Col. 6, Claim 1, line 30, change "cyclically" to --cyclical--.

Col. 8, Claim 2, line 4, change "polygnal" to --polygonal--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*